United States Patent [19]

Menard

[11] Patent Number: 4,997,139

[45] Date of Patent: Mar. 5, 1991

[54] SANITARY DOOR HANDLE COVER DISPENSING DEVICE

[76] Inventor: Yves Menard, 1654 Pioneer Way, El Cajon, Calif. 92020

[21] Appl. No.: 347,186

[22] Filed: May 4, 1989

[51] Int. Cl.[5] ..... B65H 16/10; E06B 7/00

[52] U.S. Cl. ..... 242/67.1 R; 242/55.2; 49/70; 116/110; 116/111

[58] Field of Search ..... 160/127; 49/70, 460; 242/55.2, 55, 67.1 R; 16/110 R, 111 R, 124

[56] References Cited

U.S. PATENT DOCUMENTS

| | | | |
|---|---|---|---|
| 2,903,734 | 9/1959 | Inman | 16/111 R |
| 4,153,970 | 5/1979 | Perkinson | 49/70 X |
| 4,644,689 | 2/1987 | Arians | 49/70 |
| 4,658,469 | 4/1987 | Hawkins | 16/110 R |
| 4,710,634 | 12/1987 | Brookes | 16/110 R X |

*Primary Examiner*—Stuart S. Levy
*Assistant Examiner*—Steven M. duBois
*Attorney, Agent, or Firm*—Frank D. Gilliam

[57] ABSTRACT

The invention is directed to a dispensing device for the automatically dispensing of a sanitary covering for rest room exit door handles, laboratory doors and the like. The door handle is enclosed with a dry sanitary covering which is replaced from a supply reel with each closing of the door.

18 Claims, 2 Drawing Sheets

SANITARY DOOR HANDLE COVER DISPENSING DEVICE

BACKGROUND OF THE INVENTION

The invention is directed to a continuous replacement of a dry sanitary cover for door handles used to open rest room doors or the like for exiting therefrom and more particulary to sanitary door handle covering that is automatically dispenses a clean dry cover with each closing of the door.

It is found to partially annoying for a person with dry or clean hands existing from a rest room or the like to grab the door handle for opening the door only to find an unsanitary or wet handle by reason of the last person exiting therefrom failing to either wash his hands or dry washed hands.

Large rest rooms in some instances have separate entrance and exit doors which can be pushed open in the direction of travel, i.e. pushed away from the user in either specific direction of travel. With these types of doors a person can select a dry portion to push against for exit.

Generally stated, small rest rooms such as, in service stations, office buildings and the like have a common automatically closing entrance and exit door which is pushed inward for entrance and pulled inward by a handle for exit. It is this type of door which this invention is directed.

Until the emergence of the present invention, there has been no known means of maintaining a sanitary and dry handle on the doors used for exiting a rest room or the like.

SUMMARY OF THE INVENTION

The invention consists of a automatic dispensing device installed on a rest room door that dispenses a length of sanitary dry tube like material from a storage reel. The tube like material encloses the gripping portion of the door opening handle. For example, a person grabs the door handle for exiting the rest room and pulls the handle and door inward toward the person opening the door for allowing that person to exit. During the last part of the closure of the door after the person exits, an actuating arm interconnected to the door jam causes mechanism within the device to translate the handle cover replacing the translated cover with a new cover or length of dry sanitary tube like material.

If the person exiting the door had unsanitary or wet hands the handle cover which they touched is replaced with a new dry sanitary cover upon the action of the door closing.

An object of this invention is to maintain a sanitary gripping surface to the handle employed on a door used for exiting a rest room or any room which the door handle can become unsanitary by use.

Another object of this invention is to maintain a dry gripping surface to the handle employed on a door used for exiting a rest room or any room which the handle of the door can become wet by use.

Another object of this invention is to automatically replace an unsanitary door handle cover with a sanitary cover between uses of the door handle.

Another object of this invention is to automatically replace a wet door handle cover with a dry cover between uses of the door handle.

Still another object of this invention is to provide a device for dispensing dry handle covers by the last few inches of travel of door closure.

Other objects, advantages and novel features of the invention will become apparent from the following detailed description of the invention when considered in conjunction with the accompanying drawings wherein:

BRIEF DESCRIPTION OF THE DRAWING FIGURES

DESCRIPTION OF THE PREFERRED EMBODIMENT

Figure 1:
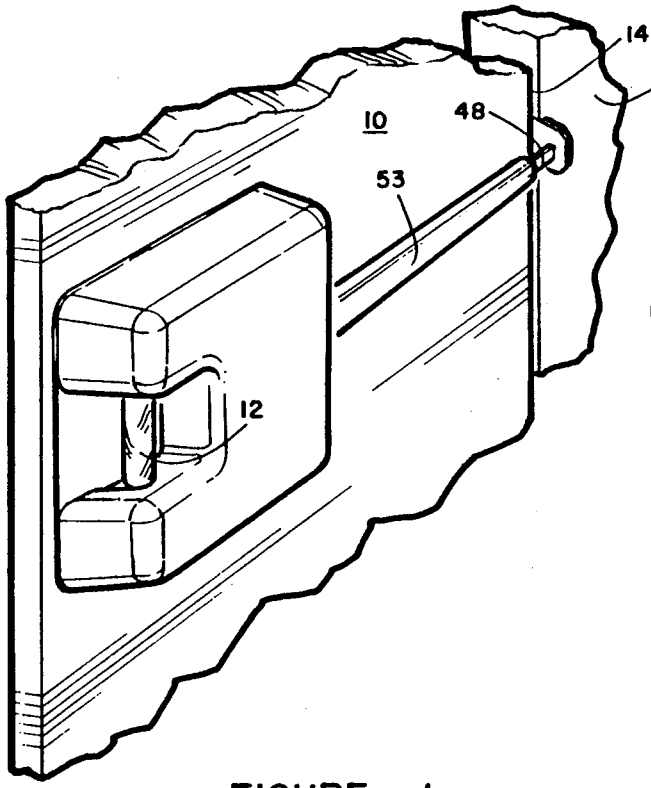
FIG. 1 is a perspective showing of the invention mounted on a door shown in cutaway.

Referring now to drawing FIG. 1, a door 10 which pulls toward the viewer by grasping the handle member 12 causing the door to pivot rotating the handle member 12 toward the door jam 16 and providing an opening, not shown, through which a person can now exit.

Figures 2, 4:
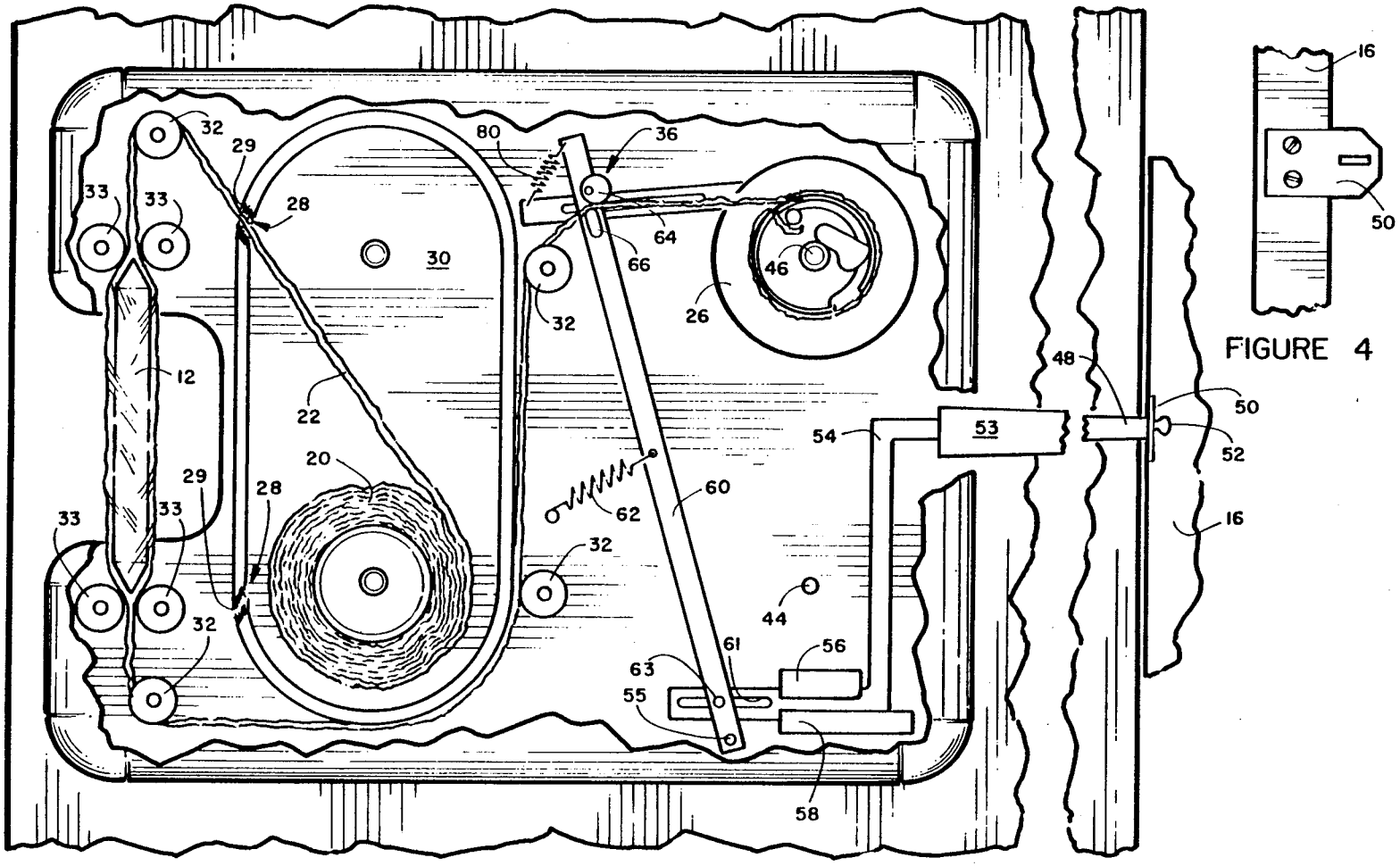
FIG. 2 is a showing of the tube dispensing mechanism of the invention.
FIG. 4 is a showing of the door sill connector of the actuating arm.

Referring now to drawing FIG. 2, the operating mechanism of the present invention 18 is shown exposed for ease of explanation. The operating mechanism includes a supply reel 20 on which is stored a continuous length of a flattened tube like material 22 which is translated for replacement covering of the door handle member 12. The used tube like material that is the material translated from the door handle member after use is wound on a take up reel 26 by action of door just prior to reaching a full closure hereinafter explained in more detail. The flattened tube like material 22 leaves the supply reel 20 through an opening 28 in the side of supply reel chamber 30, over an idler roller 32, between a pair of idler rollers 33, a bullet like handle member 12 with each end tapered toward the distal ends is inserted within the tube like material causing the material to translatably encase the handle member 12, between another pair of idler rollers 33, around another idler roller 32, over another idler roller 32, through a locking mechanism 36 and onto take up reel 26. The openings 28 include brush like resilient bristles 29 which cover the opening when no flattened tube like material is passing therethrough and allows the tube like material to freely pass through the opening when the flattened material is present. It should be particulary noted that the flattened tube like material will preferably translate from the top downwardly onto the handle to prevent any water from dropping onto the clean dry flattened tube material.

The bristles 29 prevent foreign matter such as dirt or water from entering openings 28 either when the openings containing no tube like material or when in use but at rest from translation.

As shown in the drawing Figures, the flattened tube like material transport mechanism is used on doors that open to the left of the door jam. For doors that open to the right of the door jams the storage reel would be positioned on axle 40 rather than axle 42 and the take up reel 26 would be moved to axle 44 from axle 46 were it is shown. It should be understood that the opposite idler roller adjacent to the locking mechanism 36 would be used for doors that open to the right of the door jam.

Figure 3:
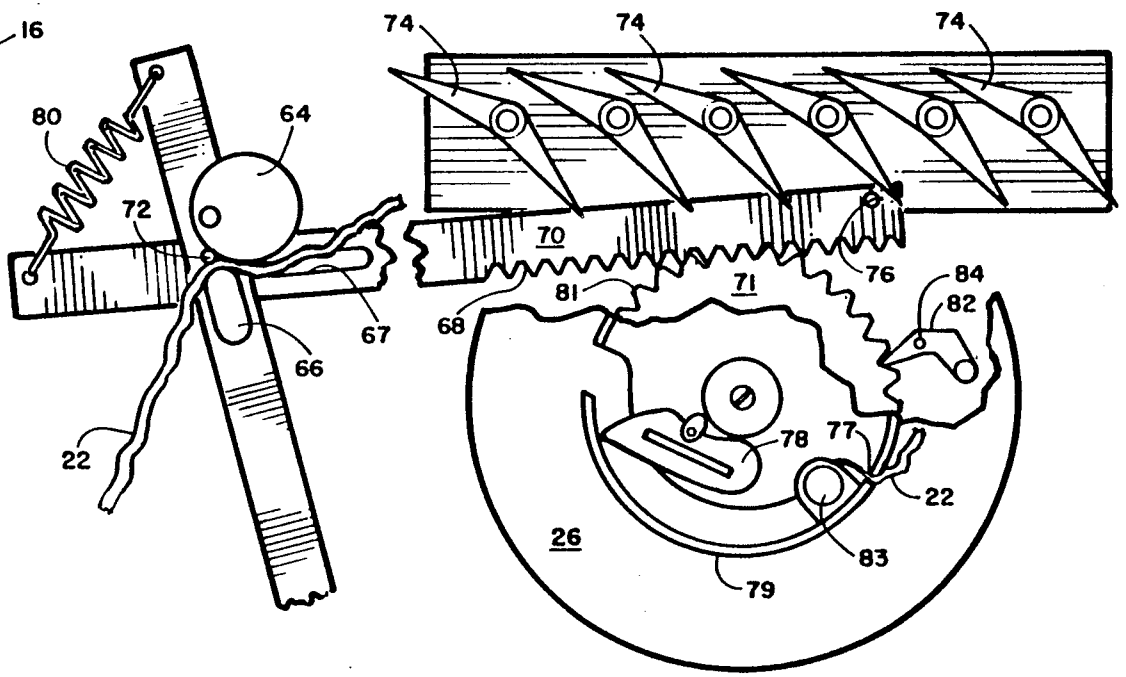
FIG. 3 is a detailed showing of the door cover translating mechanism of FIG. 2.

Referring now specificly to the details of drawing FIGS. 2 and 3, generally stated when the door is pulled toward the user the actuating arm 48 is attached to the door jam by a clip member 50, see drawing FIG. 4, by means of a large removable head 52 which is attached by threads or the like not shown. The actuating arm translates laterally in the attachment slot 53 in the clip member 50 when the door is opened and closed. The actuating arm 48 between the door edge and the door jam except for the door jam end is covered with a protective boot 53 which is attached at one end to the device. As the door is opened, the rod 54 translates toward the door between guides 56 and 58. The movement of rod 54 causes arm 60 to pivot away from the door jam by means of the action of a spring 62 pulling pivot pin 63 against the end of slot 61 in the direction of the arrow head until the door is fully opened. In this rotation action of arm 60, the cam 64 slides along the flattened tube like material allowing the rod 54 to freely translate.

When the open door is closed, the actuating arm 48 translates away from the door jam until the pivot pin 63 reaches the end of slot the slot 61 away from the door jam and again engages the end of the slot and is pulled toward the door jam by the further closing of the door to a fully closed position causing the arm 60 to rotate about pivot 55 which causes the cam 64 to grip the flattened tube like material against the tab 66. The gripping of the tube like material and the last portion of the door closure of the door after the pivot 72 has reached the end of slot 67 causes the arm 60 to pivot toward the door jam which translates the tube like material towards the take up reel 26. Ratchet teeth 68 on an arm 70 which engage like teeth on a ratchet wheel 71 which is attached to the take up reel 26 is pivotly attached to the arm 60 at the pivot point 72. A plurality of freely pivotal cam pawls 74 configured to be weight biased toward the take up reel ride along the side surface of arm 70. A Protruding pin 76 rides against each paul as it is momentarily elevated thereby.

The end of the used tube like material is locked to the take up reel 26 by means of the locking pivot arm 78 that clamps the tube like material at location 77 between the two pivoted segments 79 and 81 which pivot about pivot 83.

A coil spring 80 biases the arm 70 toward the bottom of the drawing Figure. The purpose of the spring 80 is to bias the arm 70 toward the ratchet wheel 71 when the door is closed. The protruding pin 76 causes the arm 70 to be elevated and the pin follows the surface of a first engaging cam 74 and rides along the various cam surfaces when the door is opened to elevate and disengage the teeth arm 70 and the ratchet wheel 71. The action of spring 80 and slot 67 allow for the different diameter of the take up wheel as used tube like material is accumulated thereon. In use, the arm 70 with teeth engaged operates the rotation of the take up reel 26 until all of the length of used tube like material is wound thereon and as further translation of the arm 60 which cannot further rotate take up reel 26 causes the arm 60 translates in slot 67 against the bias of spring 80 until translation of arm 60 is terminated by the complete closing of the door.

It should be understood that the teeth associated with the take up reel could be replaced by a resilient member that is engaged by the teeth on arm 70 in the same manner as the teeth associated with the take up reel.

A gravity locking member 82 which pivots freely about pivot 84 prevents rotation of the take up reel in a counterclockwise direction and allows free rotation in a clockwise direction.

In operation it should be understood that the handle member 12 is captured between the pairs of idler rollers and the sides of the case so that when the door is closed the tube like material is pulled around the handle member with the handle member remaining in position.

It should be understood that the flattened tube material can be of any material suitable for the purpose intended. Plastic material has been found to be preferable both for ease of translation around the door handle member and providing a dry handle surface. Specific material should not be considered a limitation to this invention.

Obviously many modifications and variations of the present invention are possible in the light of the above teachings. It is therefore to be understood that within the scope of the appended claims the invention may be practiced otherwise than specifically described.

What is claimed is:

1. A device for dispensing a length of dry material to a handle of a pull to open door, said door being pivotly attached to a door jam for covering said handle comprising:

a supply of said dry sanitary material in the form of a flattened tube which encloses said handle;

a first storage means for storing said dry sanitary material;

translating mechanism mechanically interconnected to said door jam and mechanically operable with the opening of and closing of said door for translating an unused length of said dry sanitary material from said supply over and enclosing said door handle; and a second storage means for storing used lengths of said dry sanitary material during translation from said handle.

2. The invention as defined in claim 1 wherein said dry material in plastic film.

3. The invention as defined in claim 1 wherein said translation mechanism comprises means to translate said dry material only during the last few degrees of rotation of the closing of said door.

4. The invention as defined in claim 1 wherein said first storage means is enclosed within a container and said dry sanitary material exists said container through an opening therethrough which includes bristles which prevent any foreign matter from entering said container.

5. The invention as defined in claim 1 wherein said translating mechanism comprises means for translating said dry sanitary material in a downward direction to prevent water of unsanitary matter from previously used dry material coming in contact therewith.

6. A device for dispensing a length of dry material to a handle of a pull to open door, said door being pivotly attached to a door jam for covering said handle comprising:

a supply of said dry sanitary material;

a first storage means for storing said dry sanitary material;

translation mechanism for translating an unused length of said dry sanitary material from said supply over and enclosing said door handle, said translating mechanism comprises means to translate said dry material only during the last few degrees of rotation of the closing of said door; and a second storage means for storing used lengths of said dry sanitary material during translation from said handle.

7. The invention as defined in claim 6 wherein said dispensing mechanism comprises means for use on doors that rotate relative to either right or left edges.

8. The invention as defined in claim 6 wherein said translating mechanism comprises means for translating said dry sanitary material in a downward direction to prevent water or unsanitary matter from previously used material from coming in contact therewith.

9. The invention as defined in claim 6 wherein said dry sanitary material is in the form of a flattened tube which encloses said handle.

10. The invention as defined in claim 6 wherein said first storage means is enclosed within a container and said dry sanitary material exists said container through an opening therethrough which includes bristles which prevent any foreign matter from entering said container.

11. The invention as defined in claim 6 wherein said translating mechanism comprises means for translating said dry sanitary material in a downward direction to prevent water or unsanitary matter from previously used material from coming in contact therewith.

12. The invention as defined in claim 6 wherein said dry material is plastic film.

13. A device for dispensing a length of dry material to a handle of a pull to open door, said door being pivotly attached to a door jam for covering said handle comprising:

a supply of said dry sanitary material;

a first storage means for storing said dry sanitary material, said first storage means is enclosed within a container and said dry sanitary material exits said container through an opening therethrough which includes bristles that prevent any foreign matter from entering said container;

translating mechanism mechanically interconnected to said door jam and mechanically operable with the opening of and closing of said door for translating an unused length of said dry sanitary material from said supply over and enclosing said door handle; and a second storage means for storing used lengths of said dry sanitary material during translation from said handle.

14. The invention as defined in claim 13 wherein said translating mechanism comprises means for translating said dry sanitary material in a downward direction to prevent water or unsanitary matter from previously used material from coming in contact therewith.

15. The invention as defined in claim 13 wherein said dry sanitary material is in the form of a flattened tube which encloses said handle.

16. The invention as defined in claim 13 wherein said translation mechanism comprises means to translate said dry material only during the last few degrees of rotation of the closing of said door.

17. The invention as defined in claim 13 wherein said translating mechanism comprises means for translating said dry sanitary material in a downward direction to prevent water or unsanitary matter from previously used material from coming in contact therewith.

18. The invention as defined in claim 13 wherein said dry material is plastic film.

* * * * *